US010961672B2

(12) United States Patent
Wahlin

(10) Patent No.: US 10,961,672 B2
(45) Date of Patent: Mar. 30, 2021

(54) CROWD CONTROL AND MANAGEMENT BARRIERS

(71) Applicant: Honeywell International Inc., Morris Plains, NJ (US)

(72) Inventor: Per Wahlin, Sigtuna (SE)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 586 days.

(21) Appl. No.: 15/899,112

(22) Filed: Feb. 19, 2018

(65) Prior Publication Data

US 2018/0238002 A1 Aug. 23, 2018

Related U.S. Application Data

(60) Provisional application No. 62/461,936, filed on Feb. 22, 2017.

(51) Int. Cl.

| | |
|---|---|
| ***E01F 13/02*** | (2006.01) |
| ***E04H 12/22*** | (2006.01) |
| ***E04H 17/18*** | (2006.01) |

(52) U.S. Cl.

CPC ..... *E01F 13/022* (2013.01); *E04H 12/2284* (2013.01); *E04H 17/18* (2013.01)

(58) Field of Classification Search

CPC ..... E01F 13/00; E01F 13/02; E01F 13/022; Y10T 403/32344; Y10T 403/32361;

(Continued)

(56) References Cited

U.S. PATENT DOCUMENTS 2,873,987 A * 2/1959 Larson ..... A47B 3/08 403/61

3,108,786 A 10/1963 Simpson (Continued)

FOREIGN PATENT DOCUMENTS

DE 9208501.6 U1 10/1992

FR 2 625 238 * 12/1987 ..... E01F 13/00

(Continued)

OTHER PUBLICATIONS

International Search Report and Written Opinion for corresponding International Application No. PCT/US2018/019163 dated Aug. 8, 2018, 17 pages.

(Continued)

*Primary Examiner* — Michael P Ferguson

(74) *Attorney, Agent, or Firm* — Alston & Bird LLP

(57) ABSTRACT

A crowd control barrier including a barrier member with side legs and feet connected to the legs, each foot having a foot member extending transverse to the barrier member. The leg-foot connections include a bracket extending up from the connected foot member and spaced substantially parallel top and bottom pins on the legs. The bracket has a substantially vertical slot above a transverse slot with the top pin slidably received in the vertical slot and the bottom pin movable transversely in the transverse slot. Teeth project upwardly from the bottom of the transverse slot with the teeth upper ends spaced less than the pin spacing from the bottom of the vertical slot. Lifting a leg slides the top pin up in the vertical slot and moves the bottom pin above the teeth whereby the leg and foot may be pivoted about the top pin whereby the bottom pin moves transversely in the second slot.

8 Claims, 9 Drawing Sheets

(58) Field of Classification Search
CPC . E04G 21/3223; E04G 21/3228; E04H 17/22; E04H 17/16; E04H 17/18
See application file for complete search history.

(56) References Cited

U.S. PATENT DOCUMENTS

| | | | | | |
|---|---|---|---|---|---|
| 3,396,928 | A * | 8/1968 | Lay | A47B 3/0815 | 248/188.6 |
| 3,925,929 | A | 12/1975 | Montgomery | | |
| 4,183,695 | A | 1/1980 | Wilcox | | |
| 4,647,016 | A * | 3/1987 | Doublet | E01F 13/022 | 256/24 |
| 4,792,258 | A * | 12/1988 | Goff | E01F 13/02 | 116/63 P |
| 6,428,242 | B1 | 8/2002 | Ward | | |
| 9,675,052 | B2 * | 6/2017 | Gingerich | A01K 1/0005 | |

FOREIGN PATENT DOCUMENTS

| | | | | |
|---|---|---|---|---|
| GB | 2 431 957 | * | 5/2007 | E01F 13/02 |
| WO | 2003/074928 | A1 | 9/2003 | |

OTHER PUBLICATIONS

Communication about intention to grant a European patent dated Jul. 30, 2020 for EP Application No. 18709228.
Communication about intention to grant a European patent dated Dec. 3, 2020 for EP Application No. 18709228.3, 5 pages.

* cited by examiner

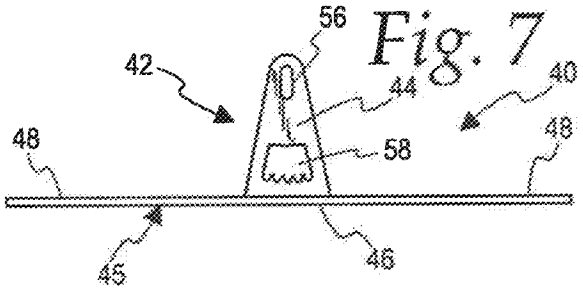
Fig. 7
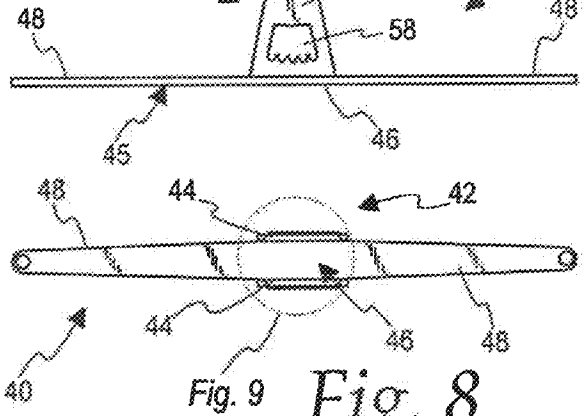
Fig. 9
Fig. 8
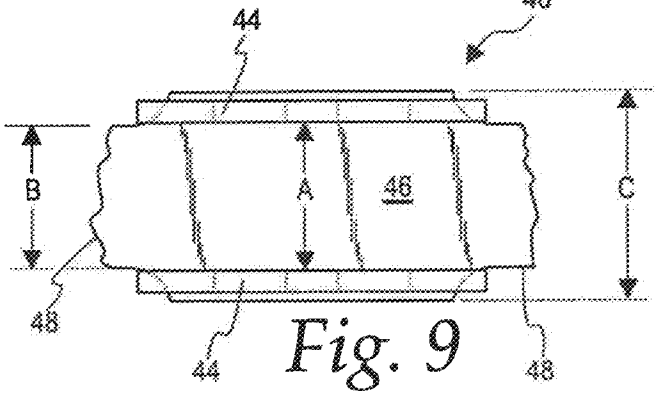
Fig. 9
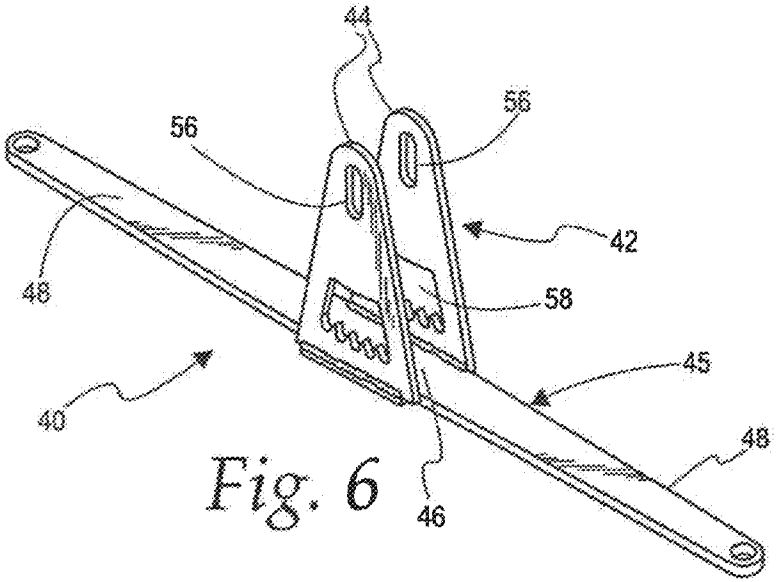
Fig. 6

CROWD CONTROL AND MANAGEMENT BARRIERS

CROSS-REFERENCE TO RELATED APPLICATIONS

This application claims priority of Provisional Ser. No. 62/461,936, filed Feb. 22, 2017, the disclosure of which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FIELD

The present invention relates to barriers for crowd control and management.

BACKGROUND

Placing barriers in areas to control crowds, whether to prevent access to certain areas or to direct the flow of a crowd, is well known.

Use of multiple barrier members to define a longer barrier is also well known. Such uses to define single longer barriers generally necessitate that the barrier members be generally alike, and yet each may need to be used in different environments and under different conditions. Standard uniform barrier members suitable for one environment/condition may be unsuited for a second environment/condition, even when used in the same locale since movement of a barrier may be necessary to adjust the crowd control to address different circumstances in particular areas (e.g., to prevent access to different areas, or to direct crowd flow in different directions). Moreover, such barriers often need to be transported to entirely different locations when used for crowd control which only temporarily necessary at a particular location (e.g., along the side of a street for a parade).

Still further, barrier members which are not vertically oriented, which is a particular concern when used on uneven ground, may present a danger of tipping should a person lean on the barrier member. Moreover, when adjacent barriers are not aligned (e.g., on uneven ground), a person walking alongside the barrier might bump into the side of one barrier member which stick out from the adjacent barrier member. Additionally, when used on uneven ground, while the foot at one side of the barrier member may lay flat on the ground, the foot on the other side of the barrier may stick up and present a significant risk of tripping anyone walking alongside the barrier.

SUMMARY

A barrier for crowd control and management is disclosed, including a barrier member with first and second side legs and feet connected to the legs with each of the feet having a foot member extending transverse to the width of the barrier member. Each of the leg to foot connections include a bracket extending up from the connected foot member and substantially parallel first and second pins on the legs. The bracket has a substantially vertical slot above a transverse slot, with the first pin slidably received in the vertical slot and the second pin movable transversely in the transverse slot. The first and second pins are spaced a distance X. and teeth project upwardly toward the vertical slot from the bottom of the transverse slot with the upper ends of the teeth spaced less than the distance X from the bottom of the vertical slot. When one of the legs is lifted to slide the first pin up in the vertical slot and move the second pin above the teeth upper ends, that leg and the connected foot may be pivoted relative to one another about the first pin whereby the second pin moves transversely in the second slot.

In a further form, the barrier member includes top and bottom crossbars secured to the first and second legs and a plurality of horizontally spaced barrier bars extending between the crossbars.

In another form, the foot members each include a central base with support members extending transversely from the central base, the support members having a maximum width and the central base being wider than the support member maximum width, and the brackets each include a pair of parallel plates extending upwardly from the central base, the bracket plates being spaced apart at least the support member maximum width. In a further form, a plurality of the barriers may be stored compactly with support members of foot members of one of the barriers positioned on top of foot members and between bracket plates of a second of the barriers.

In still another form, a plurality of the barriers have a side to side width $B_w$ with M barriers arranged for transport in a shipping container with the barrier members adjacent each other and the foot members having a width C and laterally adjacent each other, wherein shipping container has a width S, with $$M \times C \leq S - B_w,$$

wherein M is at least 3 whereby at least 3 of said barriers may be arranged for transport within the shipping container with said barrier members adjacent each other and said foot members laterally adjacent each other In a further form, the foot members each include a central base with support members extending transversely from the central base, the support members have a maximum width and the central base is wider than the support member maximum width, with the brackets each including a pair of parallel plates extending upwardly from the central base, the bracket plates being spaced apart at least the support member maximum width. In a still further form, the barriers may be stored compactly with support members of foot members of one of the barriers positioned on top of foot members and between bracket plates of another of the barriers.

Other features and advantages will become apparent from a review of the entire specification, including the appended claims and drawings.

BRIEF DESCRIPTION OF THE DRAWINGS

FIG. 6 is a perspective view of a foot including the foot member of FIGS. 4-5 and a bracket extending up from the foot member;

FIG. 7 is a side view of the foot of FIG. 6;

FIG. 8 is a top view of the foot of FIGS. 6-7;

FIG. 9 is a detailed top view of the highlighted portion of FIG. 8;

DETAILED DESCRIPTION

Figure 1:
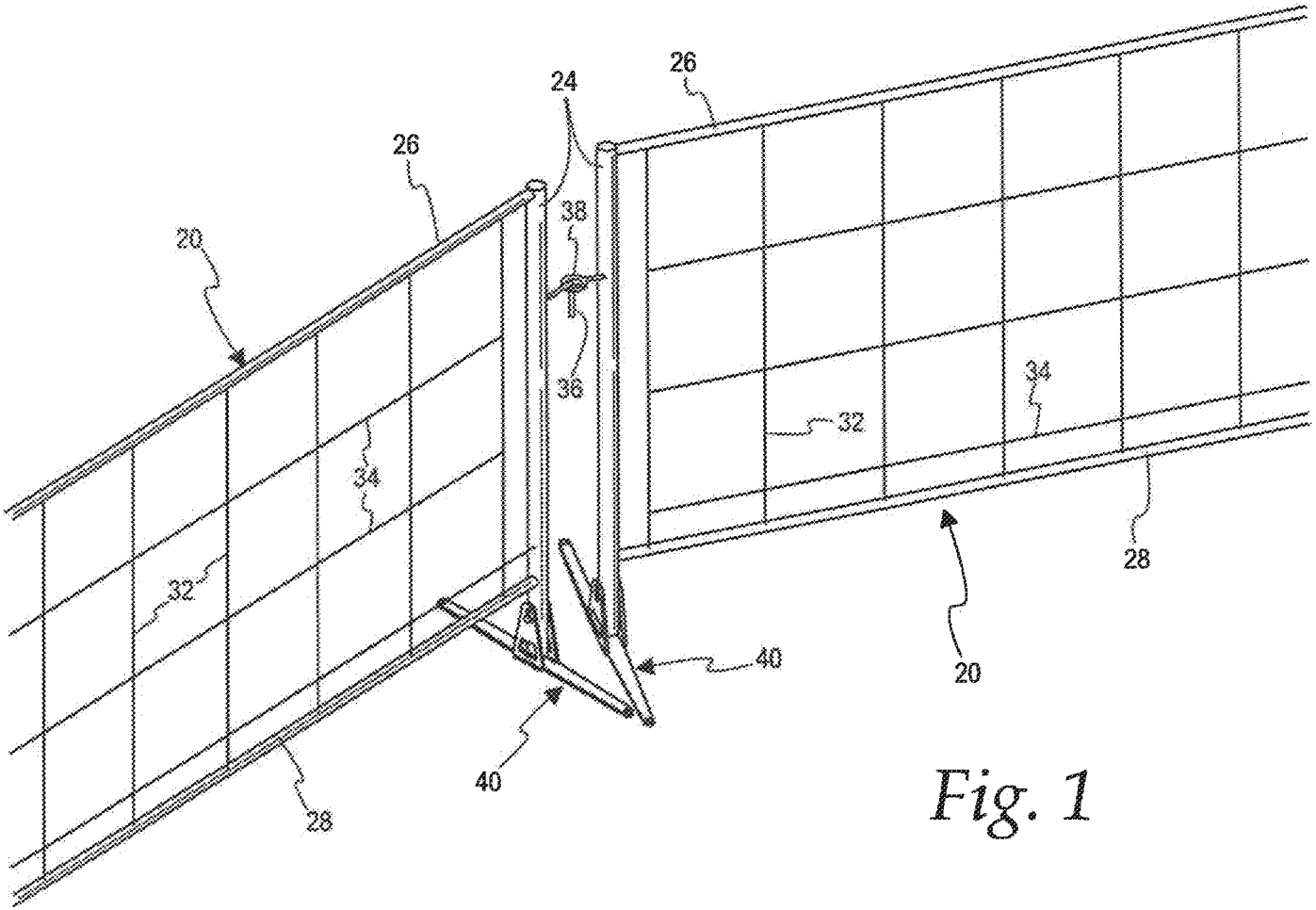
FIG. 1 is a perspective view showing two adjacent barrier members according to the present invention.

Barriers 20 as disclosed herein are variously illustrated in the Figures. Each barrier 20 includes legs 24 one opposite sides with top and bottom crossbars 26, 28 extending between the legs 24 and with vertical barrier bars 32 extending between the crossbars 26, 28. Horizontal barrier bars 34 may also be provided, where the various bars 26, 28, 32, 34 serve as barriers between the legs 24. As illustrated in FIG. 1, a hook 36 can be provided on one leg 24 and an eye connector 38 on the other whereby in use adjacent barriers 20 may be held together by dropping the hook 36 of one barrier 20 down into the eye connector 38 of the adjacent barrier 20.

Adjustable feet 40 are connected to the bottom of the legs 24 as described in detail herein.

Figure 3:
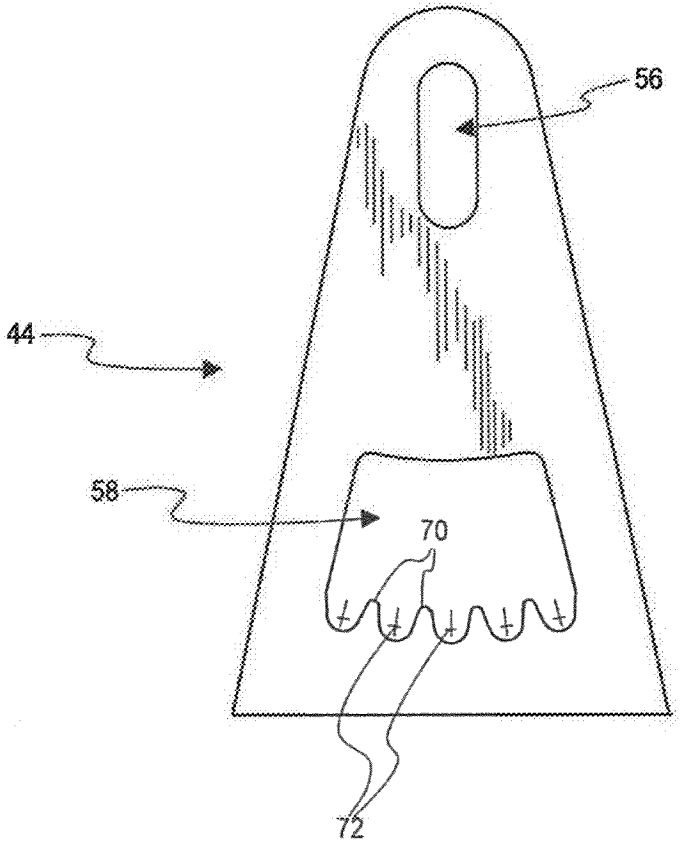
FIG. 3 is a side view of the FIG. 2 bracket plate.
Figure 4:
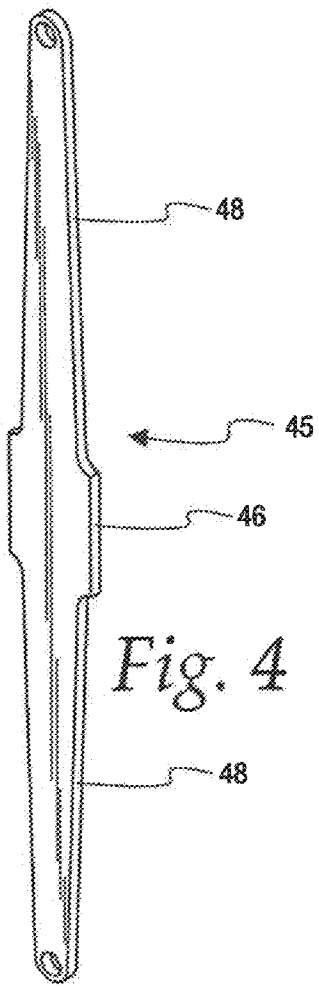
FIGS. 4 and 5 are perspective and top views, respectively, of a foot member of the FIG. 1 barrier member.
Figure 5:
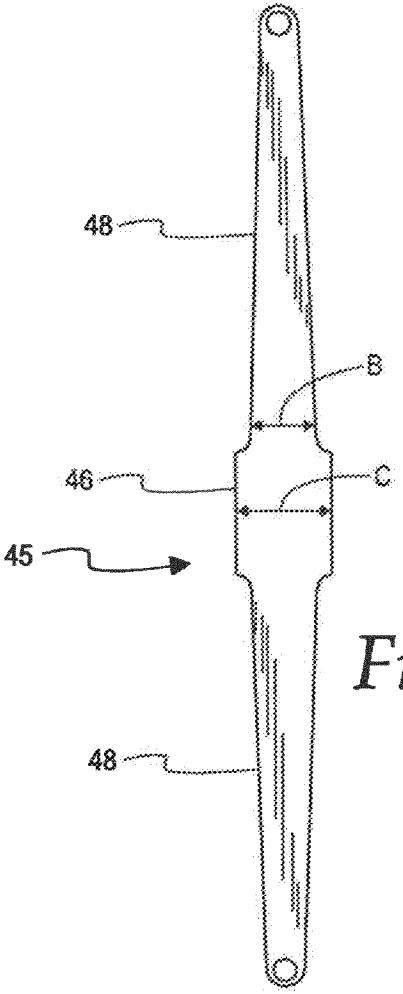

Specifically, each foot 40 includes a bracket 42 consisting of two substantially parallel bracket plates 44 (FIGS. 2-3) extending upwardly from a foot member 45 (FIGS. 4-5). The foot member 45 includes a central base 46 with support members 48 extending transversely (i.e., generally perpendicular to the associated leg 24 and horizontal barrier bars 34) from opposite sides of the central base 46. The support members 48 have a maximum width B (see FIGS. 5 and 9) less than the width C of the central base 46 (see FIGS. 5 and 9; C also being the width of the feet 40), and the bracket plates 44 are secured to opposite sides of the central base 46 so that the interior spacing A (FIG. 9) between the plates 44 is less than or equal to the maximum width B of the support members 48.

Figure 2:
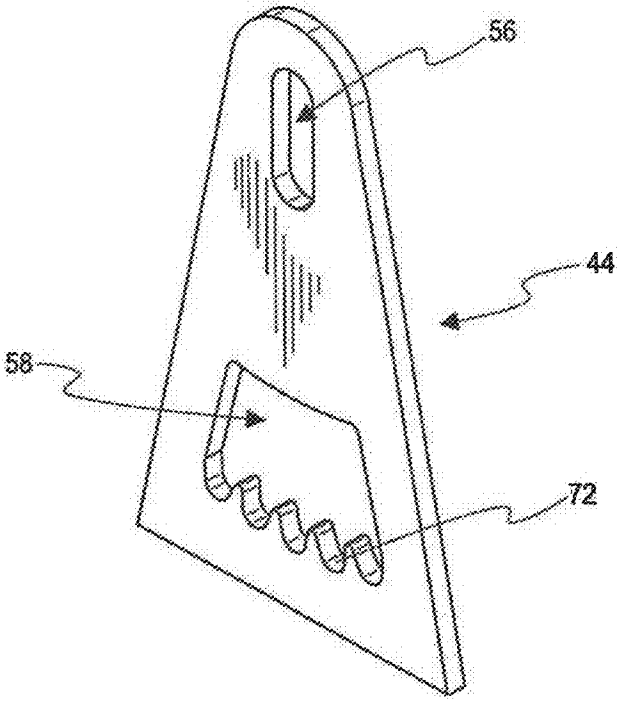
FIG. 2 is a perspective view of one side plate of the bracket connecting a leg and foot of the FIG. 1 barrier member.

Each plate 44 includes an upper vertical slot 56 and a lower transverse slot 58 (see FIGS. 2-3). The bracket plates 44 are secured to a leg 24 by vertically spaced first and second pins 60, 62 (see FIG. 10) extending laterally (i.e., generally parallel to the horizontal barrier bars 34) from opposite sides of the leg 24. The first pin 60 extends through and is slidable in the upper vertical slots 56, and the second pin 62 extends into the lower transverse slot 58.

The pins 60, 62 may be suitably configured so as to be removable in a suitable manner to facilitate disconnecting the leg 24 from the bracket plates 44 when required (e.g., for maintenance, repair or replacement). For example, the first (top) pin 60 may be hexagon head bolt and hex nut with a torque part and the second (lower) pin 62 may be a spring-type straight pin biased outwardly from opposite sides of the leg 24.

As variously illustrated in the Figures, teeth 70 extend upwardly from the bottom of the transverse slot 58 in the bracket plates 44, with notches 72 between the teeth 70 in which the second (bottom) pin 62 may fit when aligned therewith.

Advantageously, the transverse slot 58 may be configured so that its top is centered around the top of the vertical slot 56, so that when the barrier 20 is pulled up with the top pin 60 at the top of the vertical slot 56, when the leg 24 is pivoted relative to the foot 40 around the top pin 60, the bottom pin 62 will ride along the top of the transverse slot 58. Similarly, the transverse slot 58 may be advantageously configured so that the bottom of the notches 72 are spaced from the bottom of the vertical slot 56 so that when the bottom pin 62 rests in a notch 72, the top pin 60 will rest on the bottom of the vertical slot 56. Such a configuration can not only assist in easy relative motion when changing position but also assists in spreading the load equally between the pins 60, 62 to facilitate long life of the barrier 20 without overstressing and potentially damaging any of the pins 60, 62.

It should be appreciated that the spacing between the pins 60, 62 and the spacing between the bottom of the vertical slot and the bottom of the notches 72 are substantially equal so that when the first pin 60 rests on the bottom of the upper vertical slot 56 the second pin will rest in a notch 72 between teeth on the bottom of the lower transverse slot 58. Further, the spacing between the top of the first (top) pin 60 and the bottom of the second (bottom) pin 62 should be no more than the spacing between the top of the vertical slot 56 and the top of the teeth 70.

With the slots 56, 58, pins 60, 62, teeth 70 and notches 72 oriented as described, it should be appreciated that if the leg 24 is lifted up, it will slide up relative to the bracket plates 44 with the bottom pin 62 clear of the teeth 70 and notches 72 whereby the leg 24 may then be pivoted around the top pin 60 relative to the bracket plates 44 and then dropped back down into a different relative position with the bottom pin 62 in a different notch 72.

Figure 10:
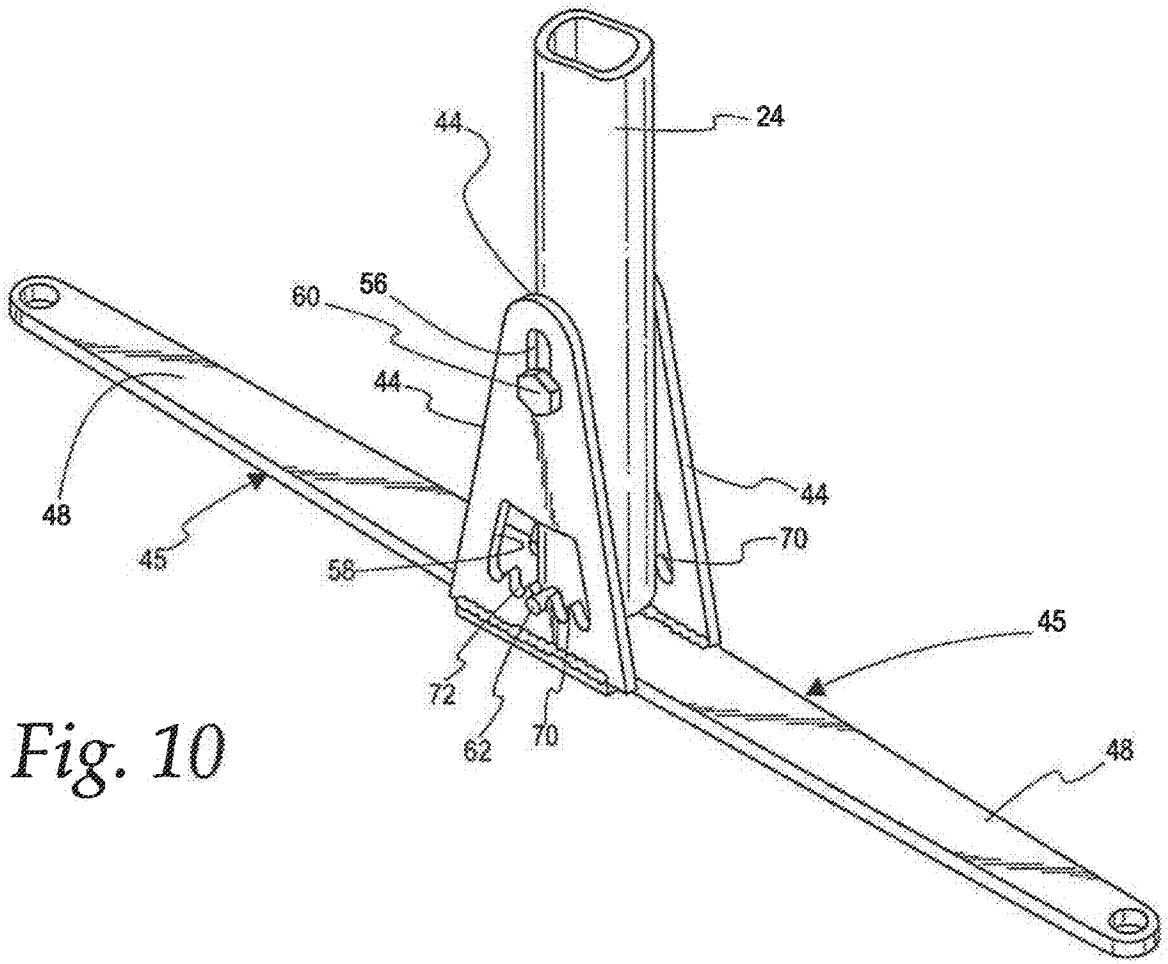
FIG. 10 is a perspective view of a foot secured to a barrier leg in one orientation.
Figure 11:
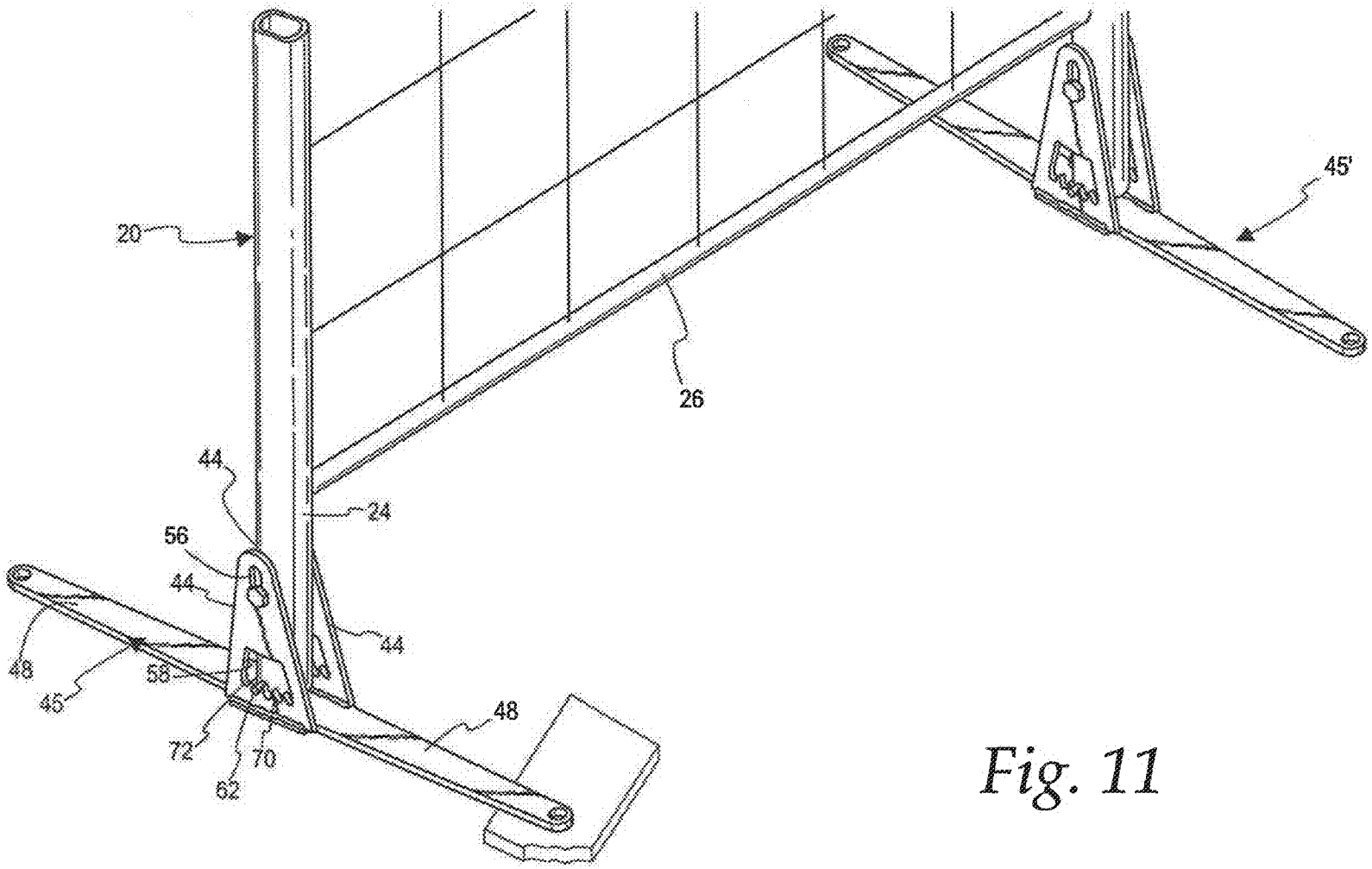
FIG. 11 is a perspective view of a foot secured to a barrier leg in a second orientation.

Thus, on level ground the bottom pin 62 may be in the center notch whereby the leg 24 will be vertical and the foot member 45 is horizontal (see FIG. 10).

Where the ground is uneven (as illustrated in FIG. 11), however, an installer may lift up on the leg 24 (e.g., by lifting the top crossbar 26) to raise the bottom pin 62 above the teeth 70, step down on the foot support member 48 (to press it into alignment with the uneven ground), and then suitably pivot the leg around the top pin 60 to orient the leg 24 vertically. When oriented vertically, the installer may then drop the leg 24 down and the bottom pin 62 will fall into the appropriate notch 72 (other than the middle notch 72 on uneven ground) so that the leg 24 and foot member 45 are secured together in the proper orientation (i.e., with the leg 24 vertical and the foot member 45 sloped in the non-horizontal orientation of the ground).

Such adjustment may also be simultaneously performed for both legs 24 of a barrier 20 by simply lifting the entire barrier 20 so that the upper pins 60 of both legs 24 slide up to the top of the vertical slot 56 and then slowly lowering the barrier 20 down, so that the foot members 45 on both sides drop down and pivot into alignment with the uneven ground before the upper pins 60 start sliding down in the vertical slots 58 and the lower pins 62 dropped down into the appropriate notch 72.

It should also be appreciated that the orientation of the feet 45 on opposite sides of the barrier 20 may be different, as illustrated in FIG. 11 where the near foot member 45 is slanted and the far foot member 45' is horizontal on flat ground.

Figure 12:
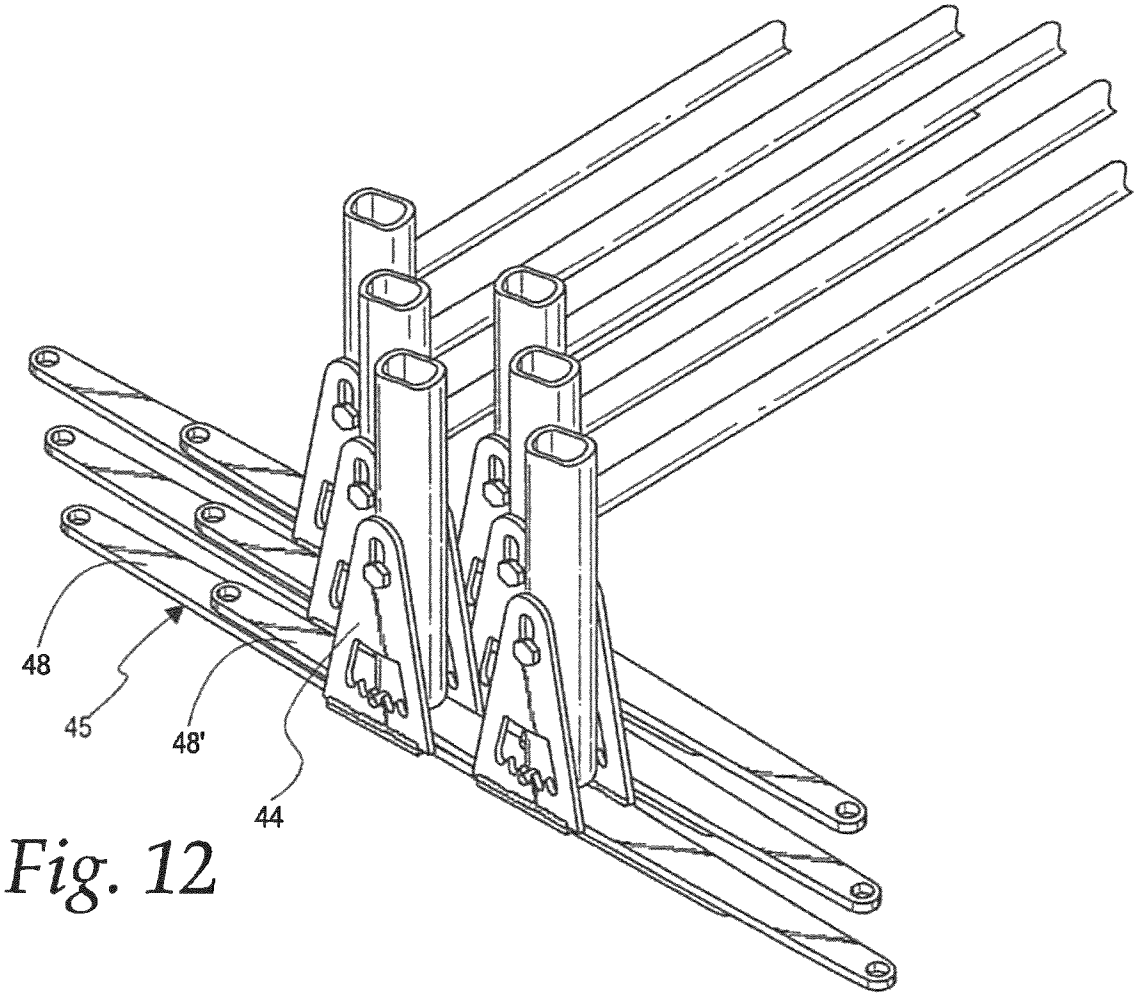
FIG. 12 is a perspective view illustrating the feet and legs of six barrier members compactly arranged for storage and/or transport.
Figure 13:
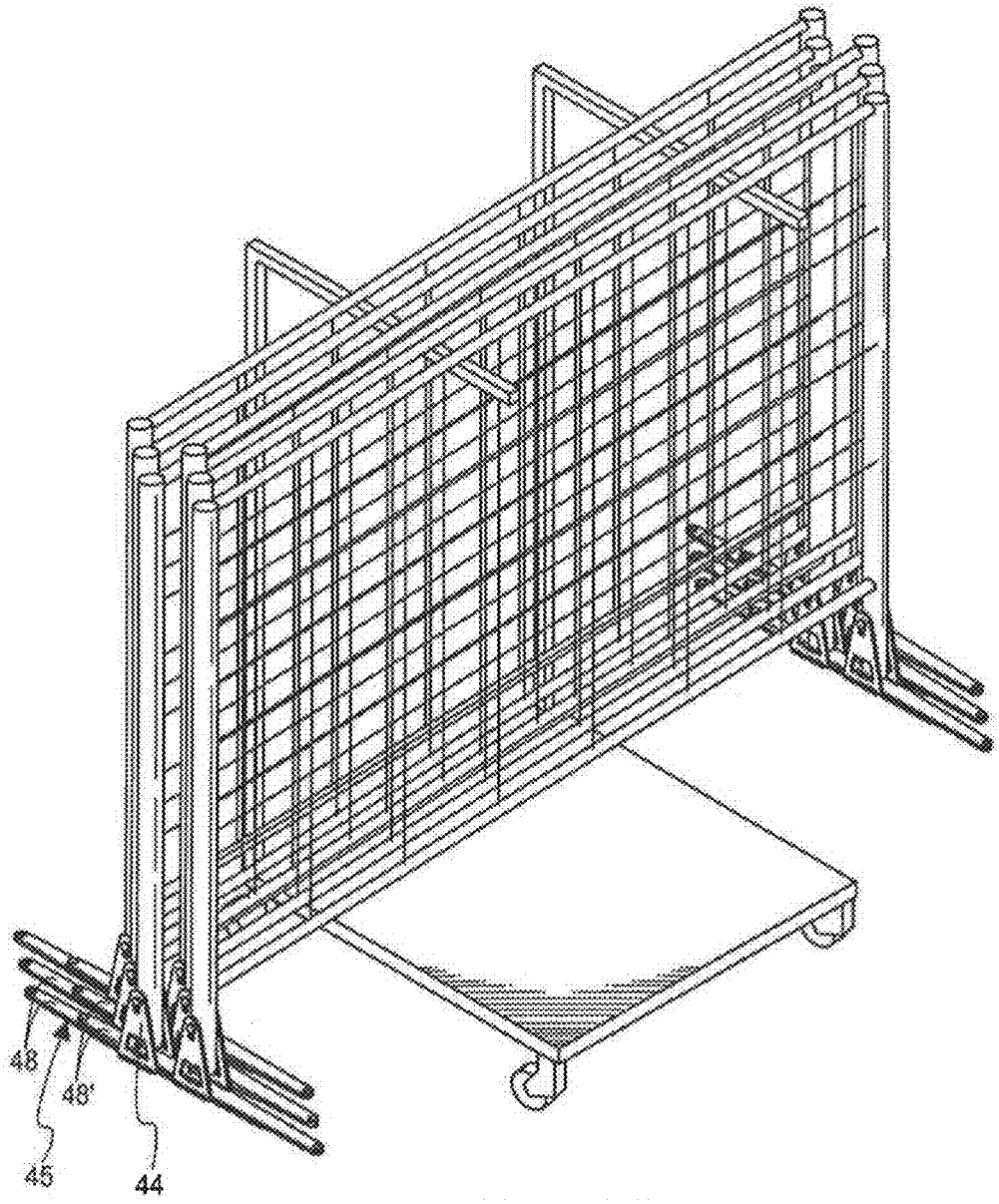
FIG. 13 is a perspective view illustrating six barrier members compactly arranged as in FIG. 12 for storage.
Figure 14:
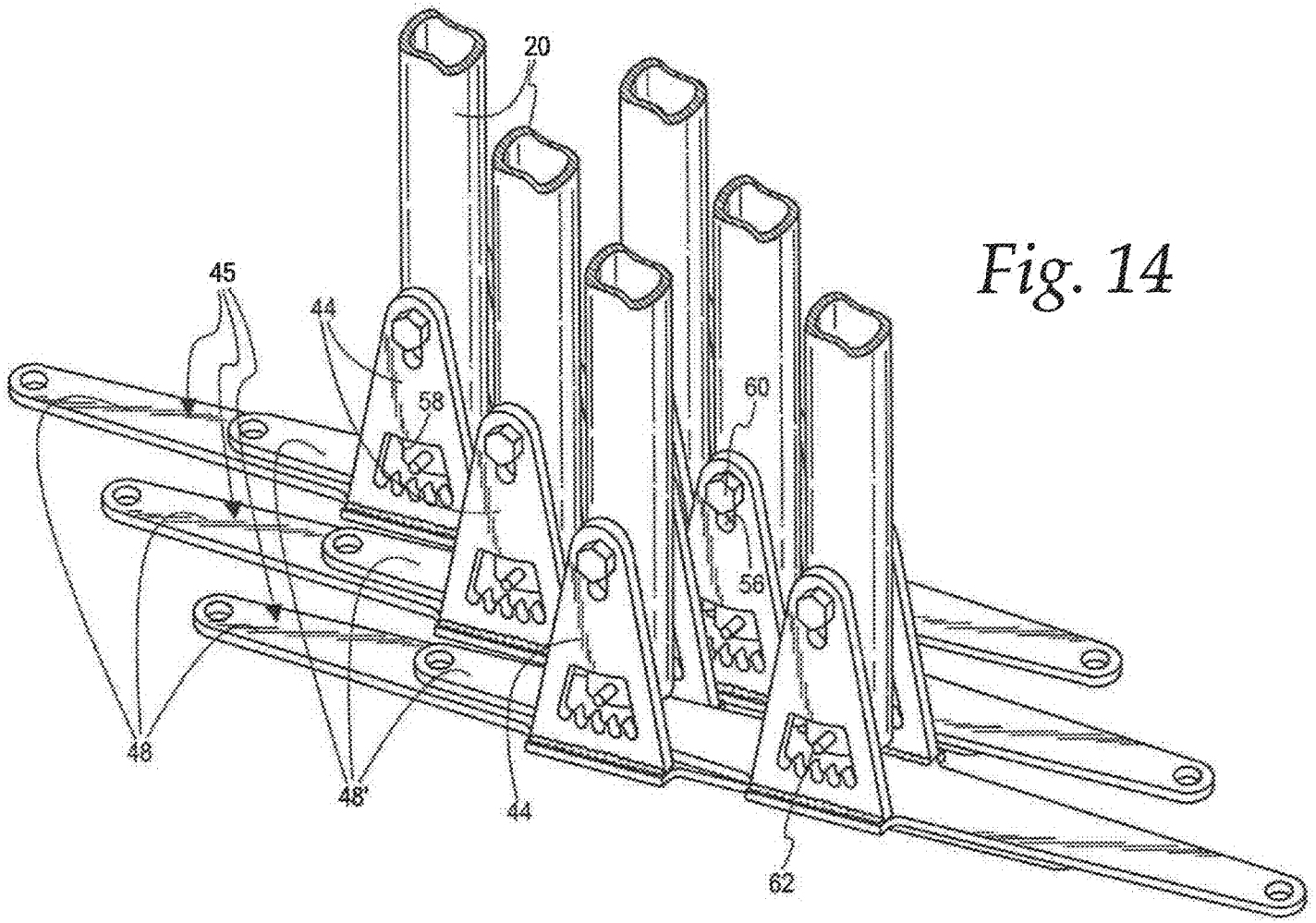
FIG. 14 is a side view illustrating the feet and legs of six barrier members as in FIG. 12.

In addition to the above described easy installation of the barriers in different environments and conditions, the barriers 20 as described herein may also be compactly stored, including advantageous storage for transport in standard sized shipping containers as illustrated in FIGS. 12-14.

That is, the overall width of the barrier 20 ($B_w$) may advantageously be less than the standard width (S) of a shipping container. This enables a plurality of barriers 20 to be stacked against one another (i.e., with the top crossbars 26 substantially against one another) with the adjacent barriers 20 offset laterally by about the width C (see FIGS. 5 and 9) of the foot member 45. Thus, multiple barriers 20 up to M in number may be stacked against each other in this manner in a storage container where M times C (M×C) is no greater than $S-B_w$ (i.e., $M\times C\leq S-B_w$). In the illustrations of FIGS. 12-14, M is three (3).

As another example, where barriers 20 are two meters ($B_w$=2 m) wide including feet on each side which are 50 mm (C=0.05 m) wide, and are to be transported in a shipping container having an interior width of 2.4 meters (S=2.4 m), then theoretically 8 barriers (M=8) could be stacked against each other as described. That is, as previously explained:

$$M\times C\leq S-B_w$$

$$8\times 0.05\leq 2.4-2,\text{ or }0.40\leq 0.40$$

(As a practical matter, in such circumstances only 7 such barriers might preferably be stacked to allow for tolerances as well as to allow some room when moving the barriers in and out of the shipping container.)

Additionally, because the spacing between the plates 44 is greater than or equal to the maximum width of the support members 48, additional barriers 20 or rows of barriers 20 may be compactly aligned with other barriers 20 by stacking one barrier 20 against another with its support members 48' overlapping on top of the foot members 45 and between the bracket plates 44 of another of the barriers 20. FIGS. 12-14 also illustrate this, with rows of three laterally offset and a second row of three aligned with the foot members of a first row of three barriers 20.

It should thus be appreciated that a plurality of advantages may variously be obtained with the barriers 20 as disclosed herein. The barriers 20 may be readily adjust to provide a safe vertical barrier 20 with feet 40 flush on even uneven ground to minimize accidental falls or tripping of people by the barriers 20. Further, the barriers 20 may be compactly stored when not in use, and may be compactly and efficiently arranged for transport.

The invention claimed is:

1. A barrier comprising:

a barrier member having a height and a width between a first side and a second side;

a first leg and a second leg secured to said barrier member adjacent the first side and the second side, respectively;

a first foot connected to said first leg and a second foot connected to said second leg, wherein each of the first foot and the second foot have respective foot members extending transverse to the width of the barrier member, and each of the first leg and the second leg to foot connections comprising:

a bracket extending up from a foot member of the respective foot members, the bracket having a substantially vertical slot above a transverse slot;

substantially parallel first and second pins secured to the respective one of the first leg and the second leg with the first pin slidably received in the vertical slot of the bracket and the second pin movable transversely in said transverse slot, said first and second pins being spaced a predefined distance apart; and teeth projecting upwardly toward the vertical slot from the bottom of said transverse slot, said teeth having upper ends spaced less than the predefined distance from the bottom of the vertical slot; and wherein in response to the respective one of said first leg and second leg being lifted to slide the first pin up in the vertical slot and move said second pin above said teeth upper ends, the one of said first leg and second leg and said connected foot are pivotable relative to one another about said first pin whereby said second pin moves transversely in said transverse slot, and wherein the first or second lea is lowered to slide the first pin down in the vertical slot and move the second pin into a notch between the teeth of said transverse slot to fix the barrier member in a desired angular position.

2. The barrier of claim 1, wherein said barrier member includes a top crossbar and a bottom crossbar secured to the first leg and the second leg and a plurality of horizontally spaced barrier bars extending between the top crossbar and the bottom crossbar.

3. The barrier of claim 1, wherein:

each foot member includes a central base with support members extending transversely from said central base, said support members having a maximum width and said central base being wider than said support members maximum width; and each said bracket includes a pair of parallel plates extending upwardly from said central base, the pair of parallel plates being spaced apart at least said support members maximum width.

4. The barrier of claim 3, wherein the support members of each foot member of the barrier are configured to be positioned on top of another foot member and between another bracket of another barrier for storage.

5. A barrier comprising:

a barrier member having a height and a width between a first side and a second side;

a first leg and a second leg secured to said barrier member adjacent the first side and the second side, respectively;

a first foot connected to said first leg and a second foot connected to said second leg, wherein each of the first foot and the second foot have respective foot members extending transverse to the width of the barrier member, and each of the first leg and the second leg to foot connections comprising:

a bracket connected to a respective one of the first leg and the second leg and extending up from a foot member of the respective foot members whereby the bottom of the one of the first leg and the second leg is spaced from the foot member;

the foot member including a central base with support members extending transversely from the central base, said support members having a maximum width and the central base being wider than said support members maximum width;

said bracket including a pair of parallel plates extending upwardly from said central base, the pair of parallel plates being spaced apart at least said support members maximum width, wherein at least one plate of each bracket has a substantially vertical slot above a transverse slot; and substantially parallel first and second pins secured to each respective first or second leg with the first pin slidably received in the vertical slot and the second pin movable transversely in the transverse slot;

teeth projecting upwardly toward the vertical slot from the bottom of said transverse slot, said teeth having upper ends spaced less than a predefined distance from the bottom of the vertical slot; and wherein in response to the respective one of said first leg and second leg being lifted to slide the first pin up in the vertical slot and move said second pin above said teeth upper ends, the one of said first leg and second leg and said connected foot are pivotable relative to one another about said first pin whereby said second pin moves transversely in said transverse slot, and wherein the first or second leg is lowered to slide the first pin down in the vertical slot and move the second pin into a notch between the teeth of said transverse slot to fix the barrier member in a desired angular position.

6. The barrier of claim 5, wherein the support members of each foot member of the barrier are configured to be positioned on top of another foot member and between another bracket of another barrier for storage.

7. A plurality of barriers arranged for transport in a shipping container, the plurality of barriers positioned adjacent each other, there being M barriers with:

each of the plurality of barriers comprising:

a barrier member having a height and a side to side width $B_w$ between a first side and a second side of the barrier member;

a first leg and a second leg secured to said barrier member adjacent the first side and the second side, respectively;

a first foot connected to said first leg and a second foot connected to said second leg, wherein each of the first foot and the second foot have respective foot members having a width C and extending transverse to the side width $B_w$ of the barrier member, and each of the first leg and the second leg to foot connections comprising:

a bracket connected to a respective one of the first leg and the second leg and extending up from a foot member, wherein the bracket has a substantially vertical slot above a transverse slot; and substantially parallel first and second pins secured to each respective first or second leg with the first pin slidably received in the vertical slot and t second pin movable transversely in the transverse slot;

teeth projecting upwardly toward the vertical slot from the bottom of said transverse slot, said teeth having upper ends spaced less than a predefined distance from the bottom of the vertical slot; and wherein in response to the respective one of said first leg and second leg being lifted to slide the first pin up in the vertical slot and move said second pin above said teeth upper ends, the one of said first leg and second leg and said connected foot are pivotable relative to one another about said first pin whereby said second pin moves transversely in said transverse slot, and wherein the first or second leg is lowered to slide the first pin down in the vertical slot and move the second pin into a notch between the teeth of said transverse slot to fix the barrier member in a desired angular position; and wherein said foot members of adjacent barrier members are laterally adjacent each other, wherein the shipping container has a width S, with $M \times C \leq S - B_w$, wherein M is at least 3 whereby at least 3 of said barriers are arranged for transport within the shipping container with said barrier members adjacent each other and said foot members laterally adjacent each other.

8. The plurality of barriers of claim 7, wherein for each of the plurality of barriers, the bottom of the respective one of said first leg and second leg is spaced from the foot member whereby the plurality of barriers are stored compactly, wherein support members of foot members of one of the plurality of barriers are positioned on top of other foot members and between another bracket of another of the plurality of barriers.

* * * * *